US006786340B2

(12) United States Patent
Ford et al.

(10) Patent No.: US 6,786,340 B2
(45) Date of Patent: Sep. 7, 2004

(54) AMBIDEXTROUS MERCHANDISE FIXTURE AND METHOD OF DISPLAYING MERCHANDISE THEREFROM

(75) Inventors: Jonathan Ford, Melrose Park, PA (US); Allan L. Ford, Melrose Park, PA (US)

(73) Assignee: Reborn Products Co., Inc., Bensalem, PA (US)

( * ) Notice: Subject to any disclaimer, the term of this patent is extended or adjusted under 35 U.S.C. 154(b) by 0 days.

(21) Appl. No.: 10/305,501

(22) Filed: Nov. 27, 2002

(65) Prior Publication Data

US 2004/0099618 A1 May 27, 2004

(51) Int. Cl.[7] ..... B42F 1/00

(52) U.S. Cl. ..... 211/59.1; 211/87.01; 211/103; 211/105.1

(58) Field of Search ..... 211/105.1, 105.2, 211/124, 103, 105.3, 59.1, 57.1, 94.01, 94.02, 181.1, 54.1, 193, 207, 208, 87.01, 187; 40/642.01; 248/220.31, 220.41, 220.42, 220.43, 214; 403/106, 108, 109.3, 109.6, 379.5, 324, 325, 349

(56) References Cited

U.S. PATENT DOCUMENTS

| | | | | | |
|---|---|---|---|---|---|
| 1,270,634 | A | * | 6/1918 | Lowe et al. | 211/105.2 |
| 1,706,887 | A | | 3/1929 | Knostman | |
| 2,020,991 | A | | 11/1935 | Brody | |
| 2,045,941 | A | | 6/1936 | Brody | |
| 2,335,030 | A | | 11/1943 | Rotheraine | |
| 2,482,003 | A | | 9/1949 | Kauffman | |
| 3,424,314 | A | * | 1/1969 | Cornelsen | 211/105.3 |
| 4,034,866 | A | | 7/1977 | Beckwith | |
| 4,474,299 | A | * | 10/1984 | Andrews | 211/193 |
| 4,606,466 | A | * | 8/1986 | Fredrickson | 211/59.1 |
| 4,747,025 | A | * | 5/1988 | Barton | 362/147 |
| 4,936,565 | A | * | 6/1990 | Fredrickson | 211/59.1 |
| 5,104,269 | A | * | 4/1992 | Hardison | 410/149 |
| 5,303,830 | A | * | 4/1994 | Metcalf | 211/57.1 |
| 5,305,898 | A | * | 4/1994 | Merl | 211/87.01 |
| 5,332,108 | A | | 7/1994 | Blass | |
| 5,526,941 | A | * | 6/1996 | Ford | 211/59.1 |
| 5,660,286 | A | | 8/1997 | Shea | |
| 5,678,702 | A | | 10/1997 | Menaged et al. | |
| 5,678,794 | A | * | 10/1997 | Kump | 248/220.31 |
| 5,803,273 | A | | 9/1998 | Menaged et al. | |
| 5,855,283 | A | * | 1/1999 | Johnson | 211/59.3 |
| 5,979,841 | A | * | 11/1999 | Piraneo et al. | 248/95 |
| 6,024,230 | A | | 2/2000 | Menaged et al. | |
| RE36,669 | E | * | 4/2000 | Zilincar, III | 211/86.01 |
| 6,070,747 | A | | 6/2000 | Shea | |
| 6,152,312 | A | * | 11/2000 | Nava et al. | 211/94.01 |
| 6,199,706 | B1 | | 3/2001 | Shea | |
| 6,202,866 | B1 | | 3/2001 | Shea | |
| 2001/0047974 | A1 | * | 12/2001 | Berlingieri | 211/106 |

* cited by examiner

*Primary Examiner*—Jennifer E. Novosad
(74) *Attorney, Agent, or Firm*—Caesar, Rivise, Bernstein, Cohen & Pokotilow, Ltd.

(57) ABSTRACT

A fixture and method of use for supporting merchandise on a vertical surface. The fixture includes a bracket and an elongated display member having a pair of ends. The bracket includes a section for snap connection to either end of the display member and a connector that is configured to engage one of various types of support structures mounted on the vertical surface. Those support structures are a conventional slotted upright, a wire rack, a slat wall and a peg board. The display member include merchandise holders, e.g., prong hangers, for holding the merchandise thereon, e.g., suspending the merchandise therefrom.

20 Claims, 7 Drawing Sheets

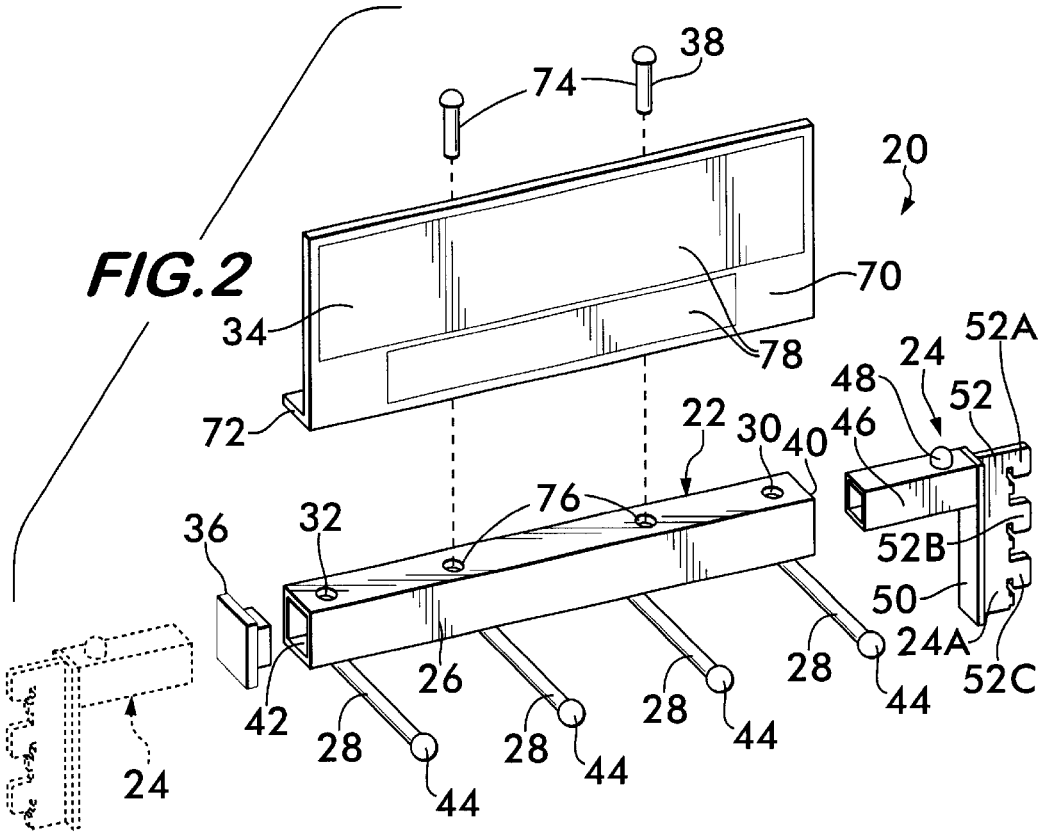
FIG.3
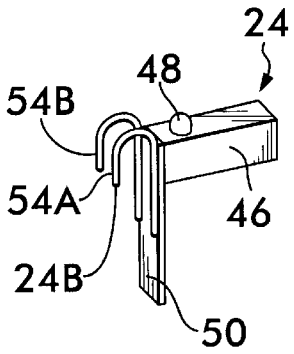
FIG.4
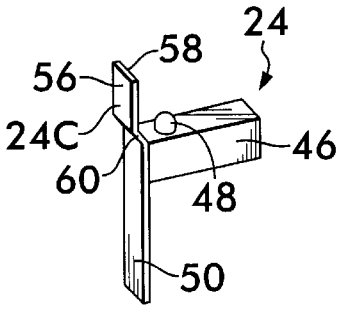
FIG.5
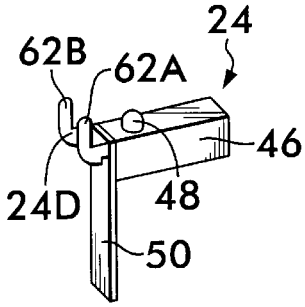

12
202
200
204
20
34
24B
54B
54A
50
34
26
28
28
36
22
44
26
54A
54B
24B
36
20
22
28
50

12
400
402
24D
62A
62B
34
36
26
28
50
22
34
36
26
28
50
24D
22

AMBIDEXTROUS MERCHANDISE FIXTURE AND METHOD OF DISPLAYING MERCHANDISE THEREFROM

BACKGROUND OF THE INVENTION

1. Field of Invention

This invention relates to merchandising display assemblies and, more particularly, to a merchandise fixture for attachment to a vertically oriented structural member, such as a conventional slotted upright or standard for shelving, a wire rack, a slat wall, a peg board, etc.

2. Description of Related Art

Various structures for displaying merchandise are commonly found in commercial enterprises and many are the subject of patents. Many of such structures make use of a horizontally disposed member arranged to be mounted on a vertical surface to support, e.g., suspend, merchandise for sale or other purposes.

For example, In U.S. Pat. No. 6,202,866 (Shea) there is disclosed a merchandising display assembly mounted to and extending from an upwardly extending support surface. The support surface has an elongate and single slotted backplate with a plurality of spaced apart and linearly extending slots. A horizontally extending member is mounted to and extends from the support surface. In one embodiment the horizontally extending member includes first and second elongated portions and axially adjusting means for establishing a length between the elongated portions. In a further embodiment the horizontal extending member is formed by a single fixed and extending portion. An elongated display member is secured to an outer end of the a horizontal member in freely swinging and suspended fashion and extends in parallel fashion relative to the vertical support surface at a spaced distance. The display member exhibits a substantially flattened display area for securing thereon a plurality of hanger portions which are in turn capable of supporting large volumes of small sized merchandise without obscuring additional merchandise located on the vertical support surface.

In U.S. Pat. No. 6,199,706 (Shea) there is disclosed a merchandising display assembly mounted to a vertical support surface. The support surface has a number of spaced apart and apertured receiving portions formed therethrough. At least one horizontally extending member is mounted to and extends from the support surface. The horizontally extending member includes first and second telescoping and elongated portions and axially adjusting means for establishing an overall length between the elongated portions. An elongated display member is secured to an outer end of the second telescoping portion and extends in parallel fashion relative to the vertical support surface at a spaced distance. The axially adjusting means permit the display member to be adjusted to a desired spaced position relative to the vertical support surface and the display member is capable of supporting large volumes of small sized merchandise without obscuring additional merchandise located on the vertical support surface.

In U.S. Pat. No. 6,070,747 (Shea) there is disclosed a merchandising display assembly structure mounted to a vertical support surface. The support surface has an elongate and single slotted backplate with a plurality of spaced apart and linearly extending slots. At least one horizontally extending member is mounted to and extends from the support surface. In one embodiment the horizontally extending member includes first and second elongated portions and axially adjusting means for establishing a length between the elongated portions. An elongated display member is secured to an outer end of the at least horizontal member and extends in parallel fashion relative to the vertical support surface at a spaced distance. The display member exhibits a substantially flattened display area for securing thereon a plurality of hanger portions which are in turn capable of supporting large volumes of small sized merchandise without obscuring additional merchandise located on the vertical support surface.

Other display assemblies having horizontally projecting members for mounting on a vertical surface are disclosed in the following U.S. Pat. Nos.: 1,706,887 (Knostman), 2,020,991 (Brody), 2,045,941 (Brody), 2,335,030 (Rotheraine), 2,482,003 (Kauffman), 4,034,866 (Beckwith), 5,332,108 (Blass), 5,660,286 (Shea), 5,678,702 (Menaged et al.), 5,803,273 (Menaged et al.), and 6,024,230 (Menaged et al.).

While the aforementioned prior patents appear generally suitable for their intended purpose, they still leave something to be desired from one or more of the standpoints of simplicity of construction, ease of use, ability to be used on various types of vertical support surfaces and project out from those surfaces in either of two opposite directions.

BRIEF SUMMARY OF THE INVENTION

A merchandise fixture for attachment to a vertically oriented structural member, e.g., a conventional slotted upright for shelving, a wire rack, a slat wall, a peg board. The fixture comprises an elongated display member and a bracket. The elongated display member has a pair of ends and at least one hanger element located on it. The at least one hanger element is arranged for suspending an article of merchandise, e.g, a garment belt, from it.

The bracket comprises a first section and a second section. The second section extends at an angle, e.g., is perpendicular, to the first section and is arranged to be releasably snap-connected to either one of the ends of the elongated display member. The first section of the bracket includes a connector element arranged to engage a portion of the vertically oriented structural member to mount the fixture on the vertically oriented structural member from either end of the elongated display member so that the elongated display member extends outward from the vertically oriented structural member.

In accordance with one aspect of this invention the ends of the elongated display member are hollow and arranged to receive the second section of the bracket therein to form a releasably securable bayonet joint, e.g., each end of the elongated display member includes a hole therein and wherein the second section of the bracket comprises a spring loaded projection arranged to snap fit into either of the holes in the elongated display member when the second section of the bracket is received in one of the hollow ends thereof.

In accordance with another aspect of this invention the elongated display member includes a panel arranged to be secured thereto for carrying advertising or promotional indicia thereon.

In accordance with still another aspect of this invention the elongated display member includes plural hanger elements, each in the form of an elongated prong extending outward from the elongated display member.

BRIEF DESCRIPTION OF SEVERAL VIEWS OF THE DRAWINGS

The invention will be described in conjunction with the following drawings in which like reference numerals designate like elements and wherein:

FIG. 2 is an exploded isometric view of the embodiment of the merchandise fixture of FIG. 1;

FIG. 3 is an isometric view of an alternative bracket than that shown in FIGS. 1, 1A and 2, the bracket shown in this figure being arranged for mounting on a wire rack;

FIG. 4 is an isometric view of another alternative bracket than that shown in FIGS. 1, 1A, 2 and 3, the bracket shown in this figure being arranged for mounting on a slat wall;

FIG. 5 is an isometric view of still another alternative bracket than that shown in FIGS. 1, 1A, 2, 3 and 4, the bracket shown in this figure being arranged for mounting on a peg board;

DETAILED DESCRIPTION OF THE INVENTION

Figure 1:
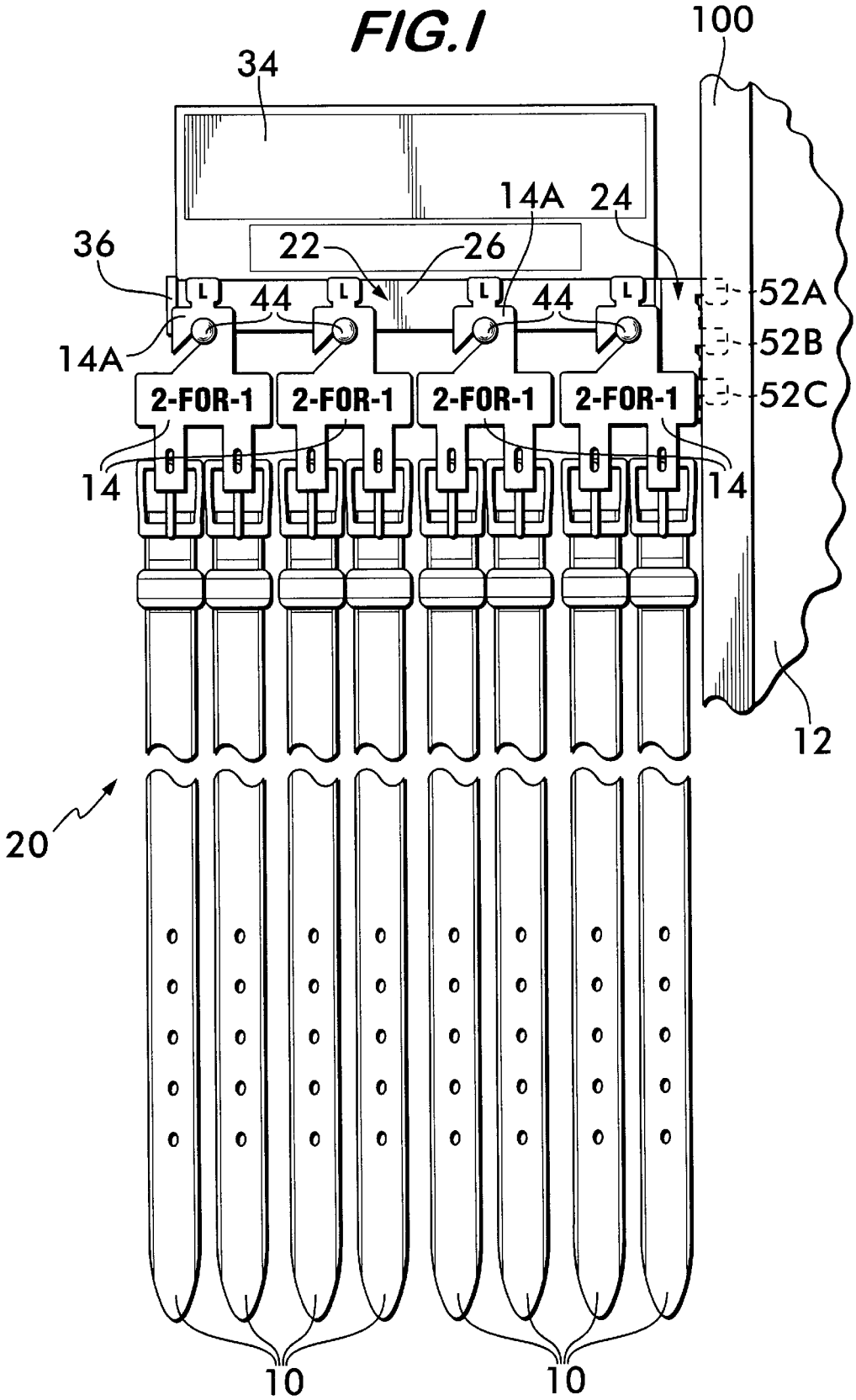
FIG. 1 is a front elevation view of one exemplary embodiment of merchandise fixture constructed in accordance with this invention and including an elongated display member and a bracket. The display member and bracket are shown mounted on a conventional slotted upright or standard for shelving that is fixedly secured on a vertical support surface, e.g. a wall, to suspend plural articles, e.g., garment belts, from the display member for vending.
Figure 6:
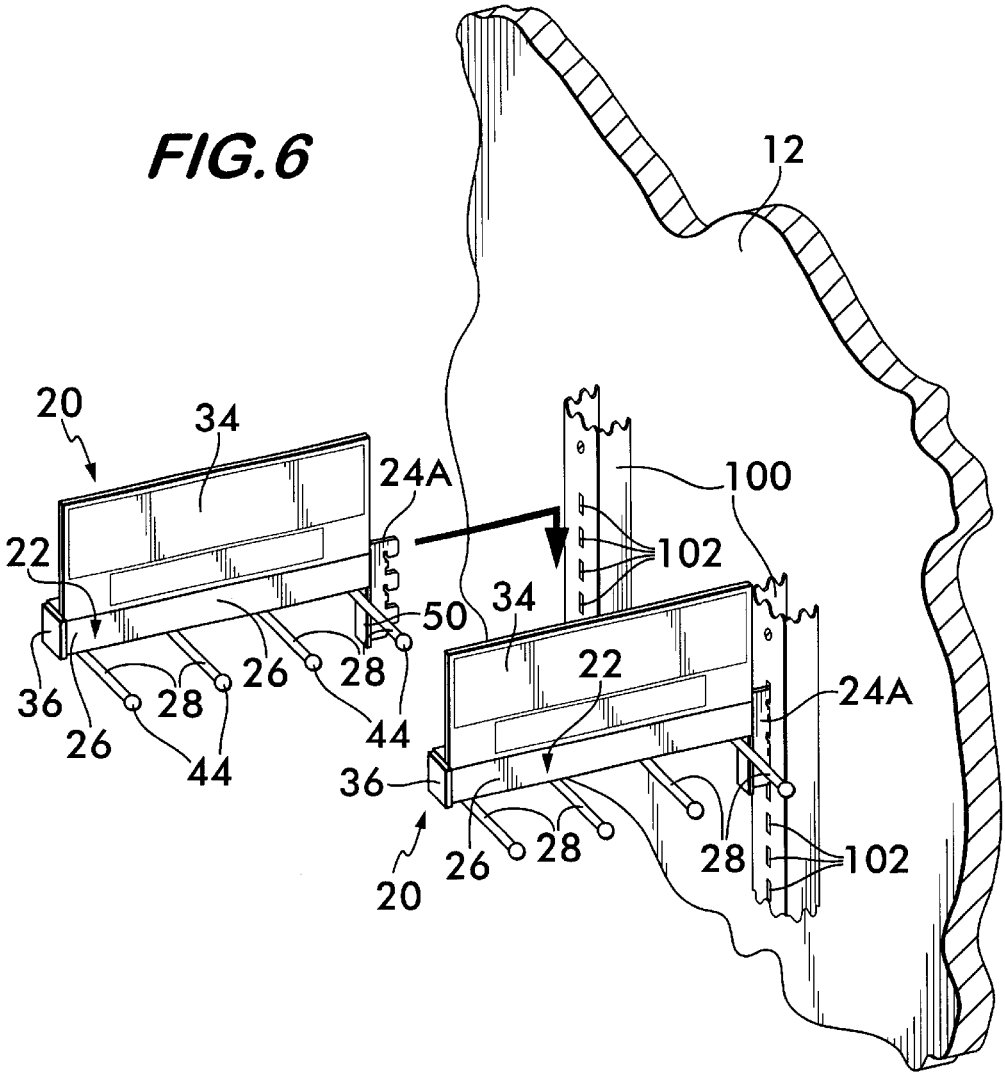
FIG. 6 is an isometric view of two fixtures of the embodiment of FIGS. 1 and 2 shown in the process of being mounted on respective conventional slotted shelving support uprights.
Figure 7:
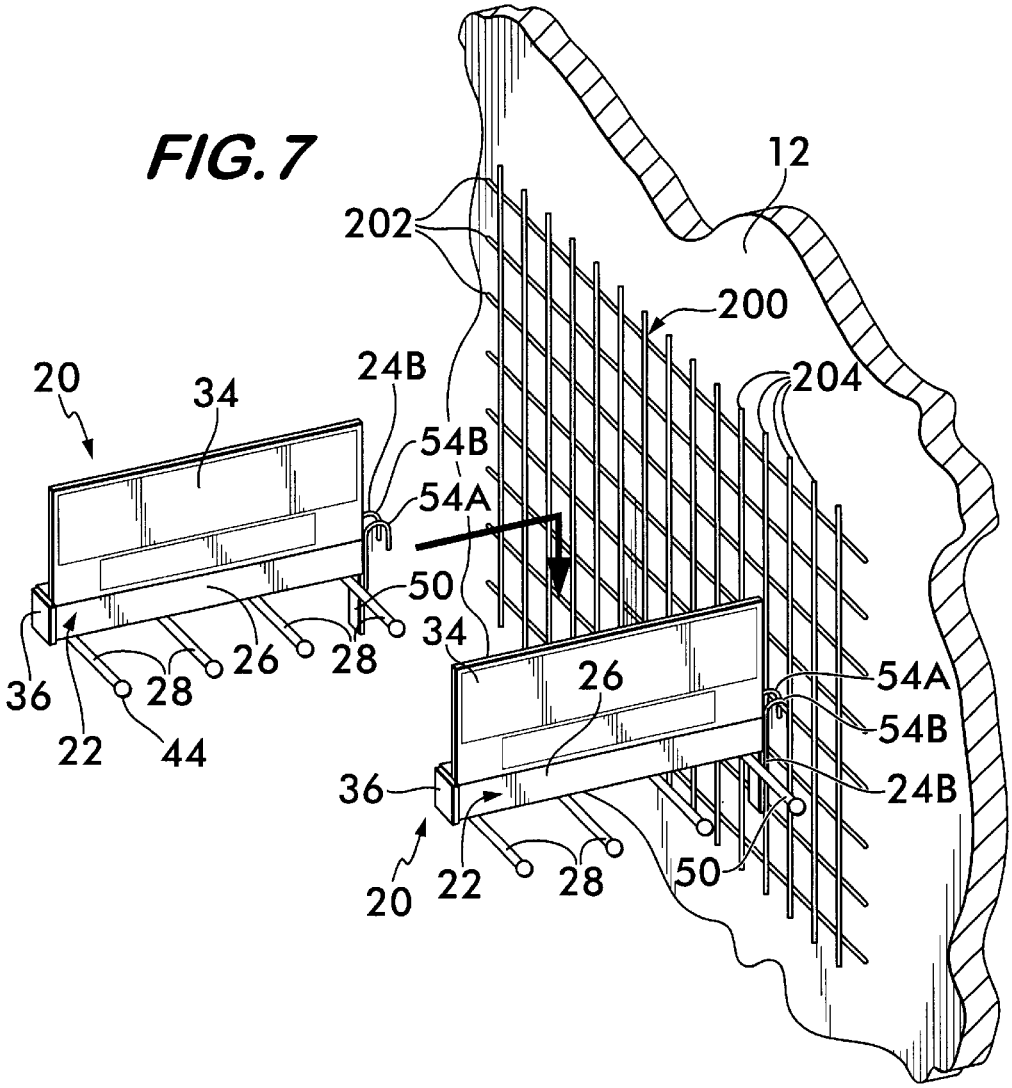
FIG. 7 is an isometric view of two fixtures making use of the bracket of the embodiment of FIG. 3 shown in the process of being mounted on a conventional wire rack.
Figure 8:
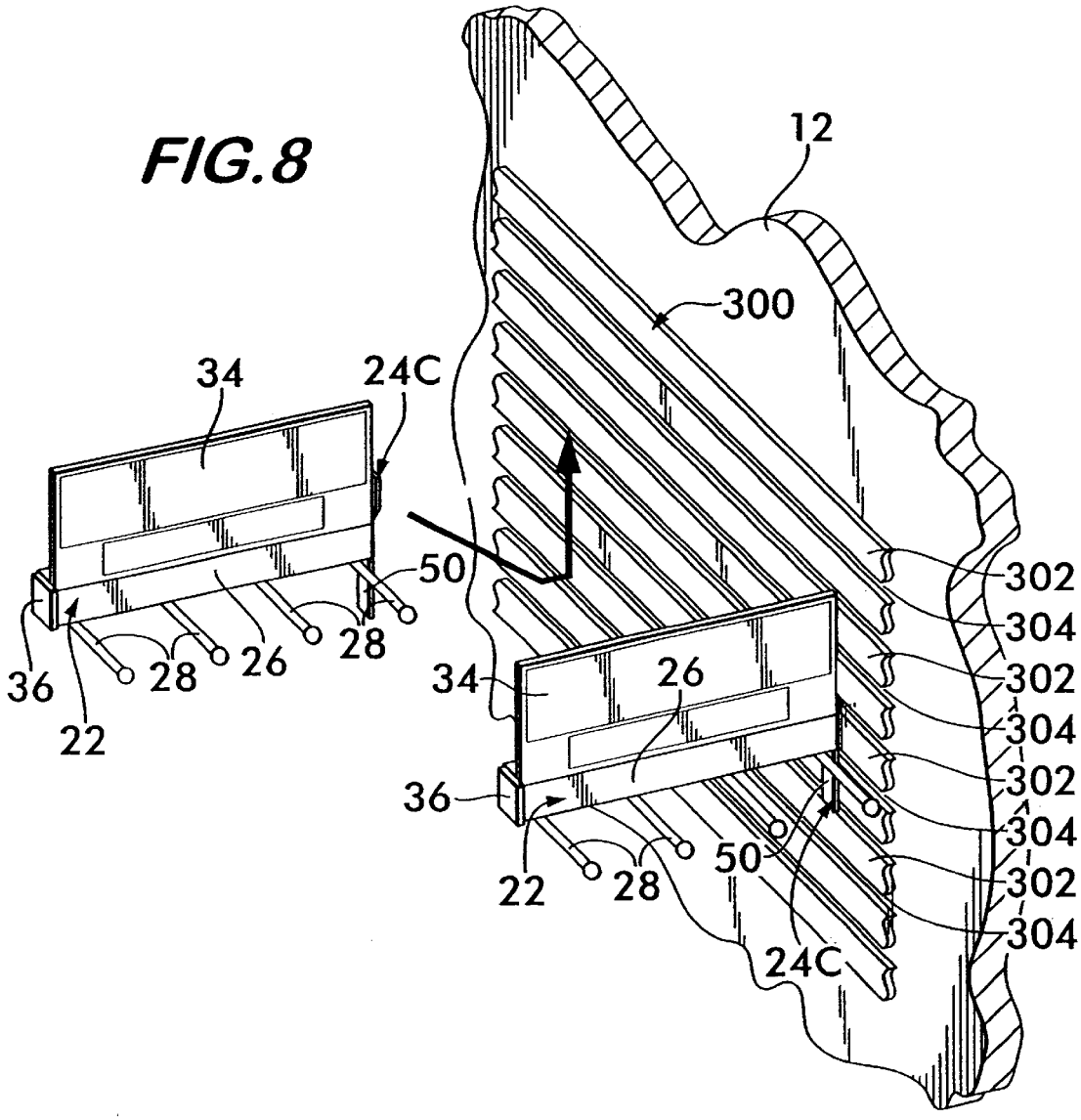
FIG. 8 is an isometric view of two fixtures making use of the bracket of the embodiment of FIG. 4 shown in the process of being mounted on a slat wall.
Figure 9:
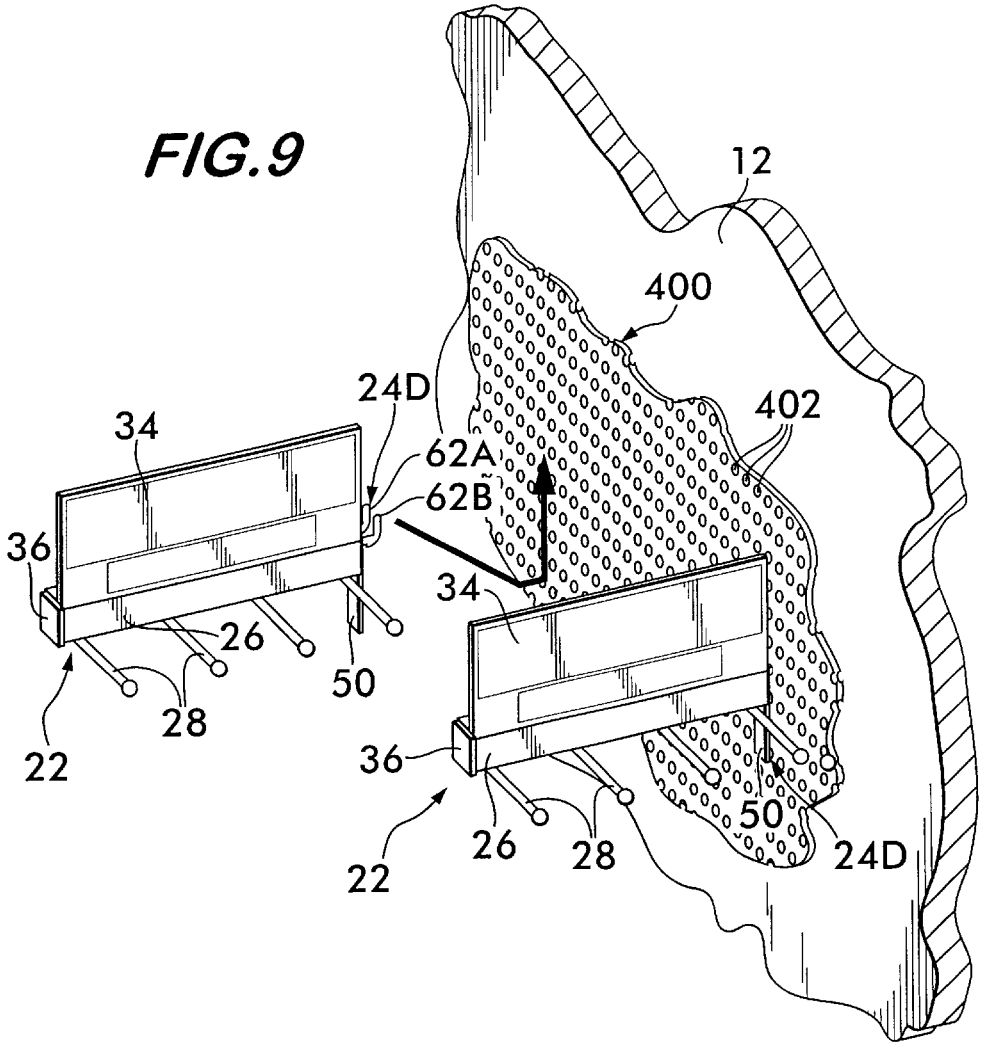
FIG. 9 is an isometric view of two fixtures making use of the bracket of the embodiment of FIG. 5 shown in the process of being mounted on a conventional peg board.

Referring now in greater detail to the various figures of the drawing, wherein like reference characters refer to like parts, one exemplary merchandise fixture embodying the present invention is generally shown at 20 in FIGS. 1 and 2. The fixture 20 basically comprises an elongated display member 22 and a bracket 24. The details of the display member 22 and bracket 24 will be described later. Suffice it for now to state that the elongated display member is arranged to hold (support or suspend) one or more items of merchandise, e.g., plural garment belts 10 (FIG. 1), thereon. The bracket 24 is in turn configured to releasably mount the elongated display member 22 on any vertical surface, such as a wall 12 (FIGS. 1 and 2). To achieve that end the bracket 24 includes an adaptor (to be described later) that is particularly constructed and arranged to cooperate with any one of various types of conventional support means mounted on the wall 12 or other vertical surface. Each bracket is of the same general construction, except for the type of adaptor it includes to releasably mount the bracket on that particular type of support means. One example of a conventional support means that can be used with this invention is a conventional slotted upright or standard 100, such as those typically used for shelving. Two such uprights 100 are shown in FIGS. 1 and 6. A bracket constructed in accordance with this invention for use with either of those uprights 100 is shown in those figures and in FIG. 2 and includes an adaptor in the form of a connector denoted by the reference number 24A (best seen in FIG. 2). Another example of a support means to which a bracket constructed in accordance with this invention can be releasably mounted is a conventional wire rack 200, such as shown in FIG. 7. A bracket constructed in accordance with this invention for use with a conventional wire rack 200 is best seen in FIG. 3 and includes an adaptor in the form of a connector denoted by the reference number 24B. Another example of a support means to which a bracket constructed in accordance with this invention can be releasably mounted is a conventional slat wall 300, such as shown in FIG. 8. A bracket constructed in accordance with this invention for use with a conventional slat wall 300 is best seen in FIG. 4 and includes an adaptor in the form of a connector denoted by the reference number 24C. Still another example of a support means to which a bracket constructed in accordance with this invention can be releasably mounted is a conventional peg board 400, such as shown in FIG. 9. A bracket constructed in accordance with this invention for use with a conventional peg board 400 is best seen in FIG. 5 and includes an adaptor in the form of a connector denoted by the reference number 24D.

Before describing the details of the adaptor/connectors 24, a description of the other components of the fixture 20 is in order. To that end, as best seen in FIG. 2, the elongated display member basically comprises a tubular member 26, a plurality of merchandise holders 28 and a pair of connector-receiving holes or apertures 30 and 32. The elongated display member is preferably formed of metal, e.g., steel, but can be formed of any tough, strong and impact resistant material, such as various commercially available plastics. The fixture 20 also includes a header 34, an end cap 36 and a header mounting assembly 38. The tubular member 26 includes a pair of ends 40 and 42, each of which is hollow. In the exemplary embodiment the tubular member 26 is linear and has a square cross-sectional shape. Each of the ends 40 and 42 of the tubular member 26 is arranged to releasably receive a portion (to be described later) of the adaptor/connector 24A–24D of the particular bracket 24 chosen for use with the wall mounted support means 100, 200, 300 and 400. This arrangement enables the bracket 24 to mount the elongated display member 22 on any of the support means 100, 200, 300 and 400 from either end of the elongated display member. Thus, the fixture can be considered to be ambidextrous in that it can be mounted so that its elongated display member 22 projects outward from the wall 12 from either end of the member and without requiring separate right handed and left handed connectors.

It should be noted that in the embodiments shown herein the elongated display member 22 is arranged so that it projects perpendicularly to the support means 100, 200, 300 and 400 and to the wall 12 on which the support means is mounted. Such an arrangement is merely exemplary. Thus, it is contemplated that the elongated display member 22 and the bracket 24 for mounting it can be constructed so that when the elongated display member is mounted on the support means it projects at some angle other than 90 degrees to the wall, e.g., extending upward at an acute angle to the wall. Moreover, the elongated display member need not be linear, e.g., it could be somewhat arcuate or some other non-linear shape so long as it includes a pair of ends, each of which is hollow, for receiving a the connector portion 24A–24D of the bracket 24 to mount it on the wall-mounted support member. Further still, the cross sectional shape of the elongated display member 22 need not be square, but can be of any shape, e.g., circular, rectangular, etc. Further yet, the elongated display member need not be hollow along its entire length, so long as it's ends are hollow.

In the exemplary embodiment 22 the merchandise holders 28 are in the form of hangers 28 for suspending the merchandise, e.g., garment belts 10, to be displayed/vended therefrom. It is to be understood that this invention is not limited to display/vending of garment belts, but can be used for displaying/vending other merchandise as well, e.g., trouser suspenders. Garment belts and trouser suspender are examples of two types of merchandise that are suitable for and typically displayed by hanging them from display racks. If the merchandise to be displayed by the fixture 20 is not suitable or desirable for hanging, the elongated support member 22 can make use of other types of holders, e.g., a shelves, etc., for supporting the merchandise thereon away from the wall 12.

In the exemplary embodiments shown the merchandise holders 28 are in the form of plural prongs. Each of the prongs is preferably formed of metal, e.g., steel, and comprises a rod having one end (not shown) fixedly secured, e.g., welded, to the underside of the bottom wall of the tubular member 26 and a free end in the form of a bulbous head. The prongs 28 are equidistantly spaced along the length of the tubular member 26. In the embodiment shown each of the prongs is of the same length, but such an arrangement is merely exemplary. Thus, the prongs can be of different lengths. In the exemplary embodiment shown, each prong 28 serves to suspend plural garment belts 10 from it. In particular, a pair of belts 10 are mounted by their buckles to a conventional plastic hanger tag 14. The hanger tag 14 includes a hook portion 14A which is arranged to snap fit over any of the prongs 28 to suspend the hanger tag and its pair of belts from that prong. Plural hanger tags may be suspended from a single prong. As is conventional, the hanger tag 14 may include advertising or promotional material (e.g., a "Two For The Price Of One" legend, like shown in FIG. 1), sizing information, etc.

The fixture 20 of this invention can be used by manufacturers or distributors of the garment belts (or other merchandise to be displayed/vended) so that the fixture is pre-loaded with the merchandise and shipped in that manner to the retailer. In such a case all that is required of the retailer is to mount the pre-loaded fixture on the particular support member 100, 200, 300 or 400 used at the store. This procedure facilitates the merchandising procedure since personnel at the store do not have to manually fill each prong with belts. If the belt manufacturer or distributor doesn't provide a pre-loaded fixture with the belts, the merchandiser can make use of its own fixture to mount it on the desired support member and then to fill its prongs with belts or other merchandise to be displayed/vended.

In my co-pending U.S. patent application Ser. No. 10/305,451, filed on Nov. 27, 2002, entitled Shipping Container with Support Member for Merchandising Plural Suspended Items, and whose disclosure is incorporated by reference herein, there is disclosed a shipping carton holding plural garment belts 10 and the fixture 20 of this invention. The carton is arranged to be assembled by the supplier or manufacturer of the belts, with the fixture 20 being in a disassembled state inside carton, i.e., the elongated display member 22 is not connected to the bracket 24. The elongated display member is, however, pre-loaded with belts, e.g., plural belts are suspended from the prongs 28 of the elongated display member, and the pre-loaded elongated display member is placed in the carton. With such an arrangement all that is required to display those belts for sale is to remove the bracket 24 from the carton and to mount the bracket 24 on whatever support means 100, 200, 300 or 400 the merchandising establishment uses. Once the bracket 24 is mounted, the pre-loaded elongated display member 22 can then be removed from the carton and mounted onto the bracket. As should be appreciated, that shipping carton and its method of use eliminates the need for the vendor to manually fill each prong with belts, thereby saving considerable time and lowering operating costs. A further advantageous feature of the shipping carton of that invention is the fact that it is constructed so that a portion of it may be used as a handle to carry the pre-loaded elongated display member 22 to the wall mounted bracket 24 to mount the pre-loaded elongated display member 22 thereon, thereby providing further economies to the merchandiser.

Figure 1A:
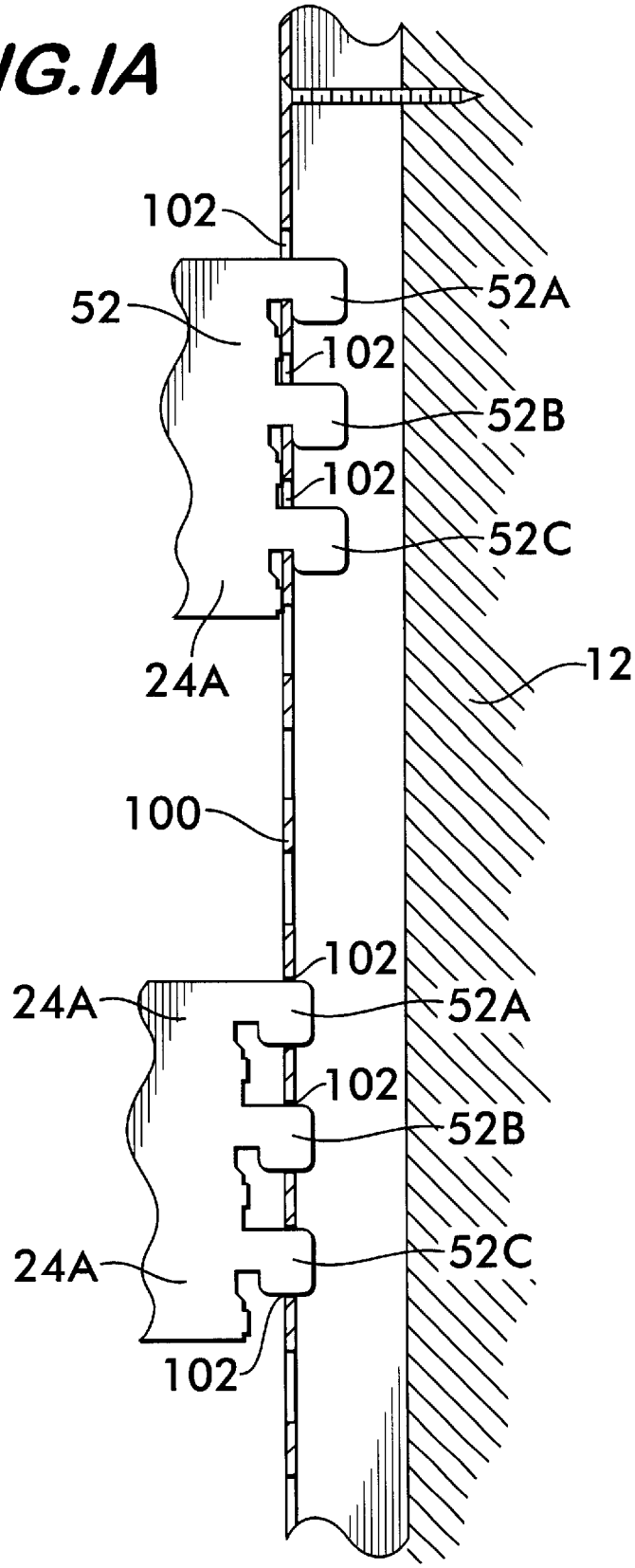
FIG. 1A is an enlarged vertical sectional view showing the manner of connecting the fixture of FIG. 1 to the conventional slotted shelving support upright or standard.

Referring now to FIG. 2, the details of the bracket 24 utilizing the connector 24A will now be described. That connector is particularly configured for releasably mounting the fixture 20 onto a conventional slotted upright 100, like that shown in FIGS. 1, 1A and 6. As can be best seen in FIG. 2 that bracket basically comprises a first section which makes up the heretofore identified connector 24A and a second section 46. The first section 46 is preferably formed of the same material, e.g., steel, as the tubular member 26, and is a somewhat elongated member that is arranged to be closely received within either open end 40 or 42 of the tubular member 26 making up the elongated display member 22. Thus, in the exemplary embodiment shown the section 46 is a hollow tube of square cross section, and whose cross sectional area is just slightly smaller than that of the hollow interior of either end 40 or 42 of the tubular member 26. This arrangement enables the section 46 to be inserted into either end 40 or 42 of the elongated display member. In order to hold the section 46 within the elongated display member, the section 46 includes detent in the form of a spring-biased ball or domed pin 48 mounted in the top wall of the section 46 closely adjacent the connector 24A. The ball/pin 48 is arranged to snap-fit into the aperture 30 when the bracket 24 is secured to the right side of the elongated display member as viewed in FIG. 2. Similarly, the ball/pin 48 is arranged to snap-fit into the aperture 32 when the bracket 24 is secured to the left side of the elongated display member in FIG. 2. The securement of the bracket 24 to the left side of the elongated display member is shown by the phantom lines in FIG. 2.

The connector 24A of the bracket 24 basically comprises an elongated planar plate or strip 50, preferably formed of metal, e.g., steel, (but could be plastic), that is fixedly secured, e.g., welded, to the end of the tubular section 46 adjacent the spring biased ball/pin 48. A conventional planar-like connector element 52 projects perpendicularly from the outer surface of the plate 50. The connector element 52 is arranged to fit within any of the slots 102 of a conventional slotted upright 100. The connector element 52 is preferably formed of metal (but could be plastic) and includes three undercut ears 52A, 52B and 52C, each of which is arranged to fit within a respective slot 102 in the slotted upright 100 to releasably mount the bracket 24 to the upright 100. To that end, in order to mount the bracket 24 onto the slotted upright 100 the ears 52A, 52B and 52C of the bracket's connector 24A are inserted into three immediately adjacent slots at the desired height on the upright as shown in the lower portion of FIG. 1A. The bracket 24 is then pushed inward so that the ears are entirely within the upright 100 and then the bracket is pushed downward to bring the undercut portions of the ears into engagement with the portions of the upright contiguous with the bottoms of the slots 102, thereby locking the bracket in place as shown in the upper portion of FIG. 1A and as also shown in FIG. 6 (see the heavy line arrow in that figure depicting the directions that the bracket is pushed to connect it to the upright 100). With the bracket 24 mounted on the upright 100, the elongated display member projects perpendicularly from the wall 12 on which the upright is mounted, thereby enabling customers to closely examine the belts 10 suspended from the fixture 20.

In order to provide a clean and finished appearance for the elongated display member 22, and to cover any potential sharp edges of its free end which might tend to injure a customer, the fixture 20 includes the previously identified cap 36. The cap is formed of any suitable material, e.g., steel, and is arranged to frictionally fit within whichever end 40 or 42 of the tubular member 26 that isn't secured to the bracket 24. In the embodiment shown in FIG. 2, the cap is shown arranged for disposition within the open end 42 of the tubular member 26. If the bracket 24 is connected to that end of the member 26 (as shown by the phantom lines in FIG. 2), the cap 36 is disposed within the opposite open end 40 of the tubular member 26.

In FIG. 3 there is shown the bracket 24 for mounting the elongated display member 22 onto a conventional wire rack 200. As is known, and as shown in FIG. 7, a wire rack 200 basically comprises a plurality of horizontal wires 202 and vertical wires 204 that are interconnected to one another in a grid-like arrangement. The wire rack may be free standing or may be mounted onto a wall 12 by means (not shown). In the embodiment shown in FIG. 7 the wire rack 200 is mounted on a wall 12, but spaced slightly from the plane of the wall.

The bracket 24 for use with a wire rack is constructed identically to the bracket 24 for use with the slotted upright, except that the bracket for use with a wire rack makes use of the alternative connector 24B. In the interest of brevity, the common components of the brackets for use with each of the various connectors 24A–24D will be given the same reference numbers and the details of their construction and operation will not be reiterated. Only their different features, e.g., their adaptor/connectors, will be described in detail. Thus, as can be seen in FIG. 3, the connector 24B basically comprises a pair of generally J-shaped hooks 54A and 54B which are fixedly secured, e.g., welded, to the outer surface of the plate or strip 50 adjacent the top end thereof so that their free ends face downward. As best seen in FIG. 7, the hooks 54A and 54B are arranged to overhang over any horizontal wire 202 of the wire rack 200 to releasably mount the bracket thereon. To that end, a bracket 24 using the connector 24B is releasably secured to the desired end of the elongated display member 22 of the fixture 20 in the same manner as described above. Then the assembled fixture is mounted on the wire rack at the desired height by merely moving it in the direction of the heavy lined arrow in FIG. 7 to extend the hooks 54A and 54B over the desired horizontal wire 202 of the rack. As best seen to the right in FIG. 7, the strip or plate 50 of the connector 24B is sufficiently long that its lower end engages a portion, e.g., a lower horizontal wire 202, of the rack to hold the bracket in a perpendicular orientation with respect to the rack and wall 12, so that the elongated display member is perpendicular to the plane thereof.

In FIG. 4 there is shown the bracket 24 for mounting the elongated display member 22 onto a conventional slat wall 300. As is known, and as shown in FIG. 8, a slat wall 300 basically comprises a plurality of horizontal slats 302 fixedly secured to a wall 12 spaced apart from one another to form a gap 304 between each immediately adjacent slat. Moreover, the slats are constructed so that portions along their lower marginal edges are spaced from plane of the wall and in communication with the gap 304 between them.

As mentioned earlier, the bracket 24 for use with a slat wall 300 includes the alternative connector 24C. As can be seen in FIG. 4, the connector 24C basically comprises an off-set extension 56 of the strip or plate 50. The off-set extension extends upward from the strip or plate 50 and terminates in a planar free end section 58. An intermediate angularly oriented section 60 interconnects the strip 50 and the planar free end section 58. The amount of off-set of the free end 58, i.e., the distance between the planes of the plate or strip 50 and the end section 58 is at least equal to the thickness of the lower edge of each of the slats 302. Accordingly, a fixture making use of a bracket 24 with the connector 24C can be readily connected to the slat wall 300 by merely angling and moving the fixture so that the free end section 58 of the connector 24C extends into the gap 304 between two slats 302 at the height desired for the fixture. Then the user pushes on the fixture in the upward directly while straightening the orientation of the fixture so that the free end section resides behind the slat immediately above that gap. The direction of movement to mount the fixture 20 on the slat wall 300 is shown by the heavy lined arrow in FIG. 8. With the off-set free end section 50 of the connector 24C in place as just described, the lower end of the downwardly extending strip or plate 50 engages the outer surface of the slat 302 immediately below that gap. This action releasably mounts the fixture onto the slat wall so that the elongated display member is perpendicular to the plane of thereof.

In FIG. 5 there is shown the bracket 24 for mounting the elongated display member 22 onto a conventional peg board 400. As is known, and as shown in FIG. 9, a peg board basically comprises a thin, generally panel formed of any suitable material, e.g., pressed board, having a plurality of equidistantly placed holes 402 across it. The pegboard is mounted on the wall so that its rear surface is spaced slightly in front of the front surface of the wall 12, to create a small space between the peg board and the wall to accommodate portions of pegs extended through the holes.

As also mentioned earlier, the bracket 24 for use with a peg board 400 includes the alternative connector 24D. As can be seen in FIG. 5, the connector 24D basically comprises a pair of pegs 62A and 62B. Each peg is of a somewhat conventional construction. In particular each peg is formed of steel or some other tough material and includes a horizontal section 64 which is fixedly secured, e.g., welded, to the plate or strip 50 adjacent the top end thereof, and a vertical section 66 extending perpendicularly to the horizontal section and directed upward. Each vertical section 66 terminates in a domed free end. A portion of the horizontal section 64 of each peg immediately adjacent the point at which it is secured to the strip or plate 50 is undercut at 68. The length and depth of the undercut portion 68 is such as to be suitable for accommodating the thickness of the pegboard 400. The pegs 62A and 62B are spaced apart be the same spacing as the holes 404 of the peg board.

A fixture making use of a bracket 24 with the connector 24D can be readily connected to the peg board 400 by merely angling and moving the fixture so that the free ends of each of the pegs 62A and 62B of the connector 24D extend through two contiguous horizontally aligned holes 402 in the peg board at the desired height for the fixture 20. Then the user pushes on the fixture in the upward directly while straightening the orientation of the fixture so that the vertical sections 66 of the two pegs reside behind the peg board immediately above the respective holes 402 through which they have been extended. The direction of movement to mount the fixture 20 on the slat wall 400 is shown by the heavy line arrow in FIG. 9. With the off-set free end section 50 of the connector 24C in place as just described, the lower portion of the edge of each of the holes 402 through which the pegs extend resides in the undercut portion of the pegs, while the lower end of the downwardly extending strip or plate 50 engages the outer surface of the pegboard immediately below those holes. This action releasably mounts the fixture onto the peg board so that the elongated display member is perpendicular to the plane of thereof.

As mentioned earlier the fixture 20 includes a header 34. The header 34 is in the form of a panel that is arranged to carry advertising or other promotional indicia thereon, e.g., pricing information, etc. The details of that panel will be described hereinafter. However, it should be noted first that the inclusion of a header in the fixture 20 is optional. Thus, if desired, the fixture 20 may not make use of any header panel, or may make use of alternative types of headers that can be mounted or secured to the fixture's elongated display member 22. In the embodiments shown herein, and as best seen in FIG. 2, the header panel basically comprises a planar panel 70 of generally rectangular shape and having a lower edge in the form of a flange 72. The header may be formed of any suitable material, e.g., polystyrene. The flange includes a pair of holes (not shown) in it. These holes in the flange 72 are arranged to accept a pair of screws or pins 74 making up a portion of the heretofore identified header mounting assembly 38. The header mounting assembly 38 also includes a pair of holes 76 in the top wall of the tubular member 26 making up the elongated display member 22. The holes 76 are spaced apart by the same distance as the holes in the flange 72 of the header panel. Accordingly, all that is required to mount the header panel 34 onto the elongated display member is to extend the screws or pins 74 through the holes in the flange 72 and the aligned holes 76 in the tubular member 26. When so mounted the header panel will be in a vertical plane to be readily visible to persons in the vicinity of the fixture 20. The front and/or rear side of the header panel can include paper, plastic or cardboard panels 78 bearing advertising or other indicia secured thereon. The securement of the panels 78 can be effected by means of an adhesive or any other suitable securement means. Alternatively the header panel 34 may have such indicia printed or molded thereon.

As should be appreciated from the foregoing, the each fixture of the subject invention can be mounted on any wall 12 or other vertical surface from either end of its elongated display member using the same bracket, by merely connecting the bracket 24 to whatever end of the elongated display member 22 is desired. The particular bracket chosen for this purpose will depend upon the type of support member the bracket is to engage. This arrangement reduces the cost for the merchandiser, since it eliminates the need keep a supply of left and right handed brackets in inventory. A further advantage of the fixture of this invention is that its assembly and disassembly can be effected easily, quickly and without the need for any tools or special techniques. All that is required to assembly the fixture is to insert the tubular section 46 of the bracket 24 into the desired open end of the tubular member 26, so that the spring-biased ball/pin snap-fits into the opening 30 or 32 as the case may be. This results in a good bayonet type connection that is resistant to accidental disconnection. To disassemble the fixture, all that is required is to press downward on the ball/pin 48 while retracting the tubular section 46 of the bracket 24 out of the tubular member 26.

While the invention has been described in detail and with reference to specific examples thereof, it will be apparent to one skilled in the art that various changes and modifications can be made therein without departing from the spirit and scope thereof.

What is claimed is:

1. A merchandise fixture for attachment to a vertically oriented structural member, said fixture comprising an elongated display member and a mounting bracket, said mounting bracket being arranged to be mounted on the vertically oriented structural member, said elongated display member having a pair of ends and at least one hanger element located on said elongated display member, said at least one hanger element being arranged for suspending an article of merchandise therefrom, said mounting bracket comprising a first section and a second section, said second section extending at an angle to said first section, each of said ends of said elongated display member being arranged to be releasably snap-connected to said second section of said bracket, said first section of said bracket including a connector element arranged to engage a portion of the vertically oriented structural member to mount said fixture on the vertically oriented structural member from the end of said elongated display member that said second section of said bracket is snap-connected to so that said elongated display member extends outward from said vertically oriented structural member.

2. The merchandise fixture of claim 1 wherein each of said ends of said elongated display member is hollow and arranged to receive said second section of said bracket therein to form a releasably securable joint.

3. The merchandise fixture of claim 2 wherein each end of said elongated display member includes a hole therein and wherein said second section of said bracket comprises a spring loaded projection arranged to snap fit into either of said holes in said elongated display member when said second section of said bracket is received in one of said hollow ends thereof.

4. The merchandise fixture of claim 2 additionally comprising a cap arranged for receipt in either of said hollow ends of said elongated display member, so that said cap can be located in the hollow end of said elongated display member that does not have said second section of said bracket received therein.

5. The merchandise fixture of claim 1 wherein said elongated display member includes a panel arranged to be secured thereto for carrying advertising or promotional indicia thereon.

6. The merchandise fixture of claim 1 wherein said hanger element comprises an elongated prong extending outward from said elongated display member.

7. The merchandise fixture of claim 6 wherein said elongated display member includes plural prongs extending outward therefrom.

8. The merchandise fixture of claim 1 wherein the vertically oriented structural member is a slotted upright or standard for shelving, and wherein said connector element of said bracket is constructed to cooperate with said slotted upright or standard to releasably secure said bracket thereto.

9. The merchandise fixture of claim 1 wherein the vertically oriented structural member is a wire rack, and wherein said connector element of said bracket is constructed to cooperate with said wire rack to releasably secure said bracket thereto.

10. The merchandise fixture of claim 1 wherein the vertically oriented structural member is a slat wall, and wherein said connector element of said bracket is constructed to cooperate with said slat wall to releasably secure said bracket thereto.

11. The merchandise fixture of claim 1 wherein the vertically oriented structural member is a peg board, and wherein said connector element of said bracket is constructed to cooperate with said peg board to releasably secure said bracket thereto.

12. A method of displaying merchandise for sale on a vertically oriented structural member mounted on a vertical surface of a retail business, comprising the steps of:

(A) providing a merchandise fixture for attachment to the vertically oriented structural member mounted on the vertical surface, said fixture comprising an elongated display member and a mounting bracket, said mounting bracket being arranged to be mounted on the vertically oriented structural member, said mounting bracket comprising a first section and a second section, said elongated display member having a pair of ends and at least one hanger element located on said elongated display member, said at least one hanger element being arranged for suspending an article of merchandise therefrom;

(B) mounting said bracket on said vertically oriented structural member;

(C) selectively releasably connecting said bracket to either one of said ends of said elongated display member, whereupon said elongated display member projects outward from said vertical surface from the end of the elongated display member to which said bracket is connected; and (D) suspending an article of merchandise from said at least one hanger element, whereupon said article of merchandise is suspended from said fixture for visibility by persons in the vicinity of said fixture.

13. The method of claim 12 wherein said article of merchandise is pre-loaded on said elongated display member before said elongated display member is mounted on said vertical surface.

14. The method of claim 13 wherein said bracket is snap connected to said elongated display member.

15. The method of claim 13 wherein said article of merchandise comprises a garment belt.

16. The method of claim 15 wherein plural garment belts are suspended from said fixture.

17. The method of claim 12 wherein said bracket is snap connected to said elongated display member.

18. The method of claim 12 wherein said article of merchandise comprises a garment belt.

19. The method of claim 18 wherein plural garment belts are suspended from said fixture.

20. The method of claim 12 wherein said method additionally comprises providing a header for said fixture bearing advertising or promotional indicia.

* * * * *